US005088624A

United States Patent [19]

Hackett et al.

[11] Patent Number: 5,088,624

[45] Date of Patent: Feb. 18, 1992

[54] ATTACK-REPELLENT DEVICE

[76] Inventors: Hugh Hackett, R.R. #1, Glencairn, Ontario, Canada, L0M, 1K0; James H. Stade, 101 Clearmont Dr., Elk Grove Village, Ill. 60007; Russell E. Hattis, 1522 Sherwood Rd., Highland Park, Ill. 60035

[21] Appl. No.: 478,654

[22] Filed: Feb. 12, 1990

[51] Int. Cl.[5] ..... B67D 5/00

[52] U.S. Cl. ..... 222/78; 222/132; 222/162; 222/175; 222/192; 222/509

[58] Field of Search ..... 222/78, 132, 135, 162, 222/175, 182, 192, 3, 402.1, 501, 509, 518; 239/152, 154, 211; 63/1.1, 2

[56] References Cited

U.S. PATENT DOCUMENTS

| | | | |
|---|---|---|---|
| 3,432,077 | 3/1969 | Voll | 222/78 |
| 3,776,429 | 12/1973 | DeLucia | 222/162 |
| 4,023,712 | 5/1977 | Babiak et al. | 222/175 |
| 4,058,237 | 11/1977 | Luke | 222/78 |
| 4,079,862 | 3/1978 | Fegley | 222/162 |
| 4,223,804 | 9/1980 | Morris et al. | 222/509 X |
| 4,241,850 | 12/1980 | Speer | 222/162 X |
| 4,402,430 | 9/1983 | Fox et al. | 222/509 X |
| 4,768,681 | 9/1988 | Dean et al. | 222/175 X |

*Primary Examiner*—Michael S. Huppert

*Assistant Examiner*—Gregory L. Huson

*Attorney, Agent, or Firm*—Wallenstein, Wagner & Hattis, Ltd.

[57] ABSTRACT

An attack-repellent device includes a housing which can be carried like a wristwatch on the arm of the user, or attachable to a waling cane, or the user's belt or neck chain. The housing includes one or more nozzles which ejects an attack-repellent chemical under the force of a propellent fluid preferably stored in one or more canisters within the housing. The inner end of each nozzle forms a projection insertable into the discharge orifice in a canister which contains a one-way valve which normally closes the discharge orifice. A spring is provided for urging one or both of the nozzle and canister toward the other. Latching means is provided for normally separating each canister from the associated nozzle. A user-operable member is provided which could be a wall of the housing which normally covers over an entry recess through which the canister or canisters are placed within the housing. This member is normally latched into an inactive position and includes a member which is interposed between the nozzle and associated canister. Activation of the device preferably occurs with the pulling of this member from its normally latched position.

17 Claims, 5 Drawing Sheets

Fig. 1
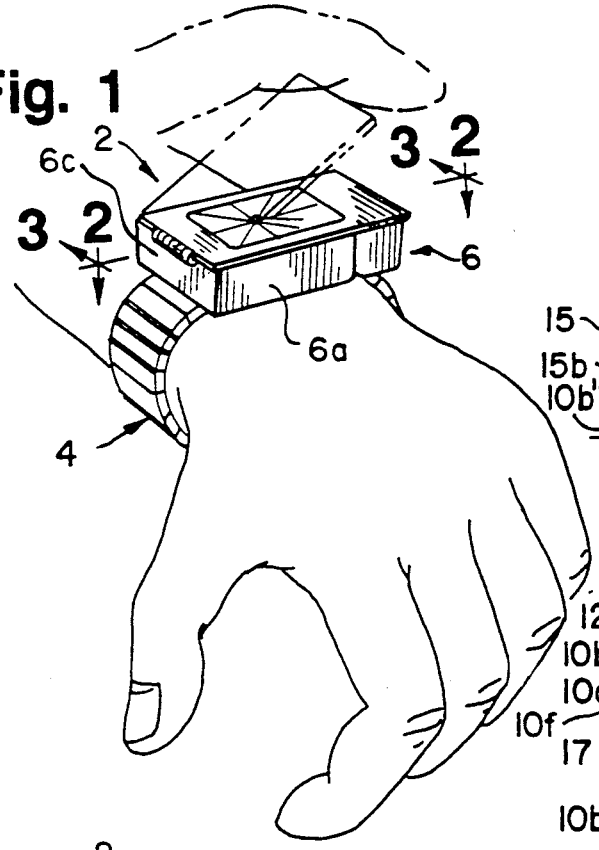
Fig. 4
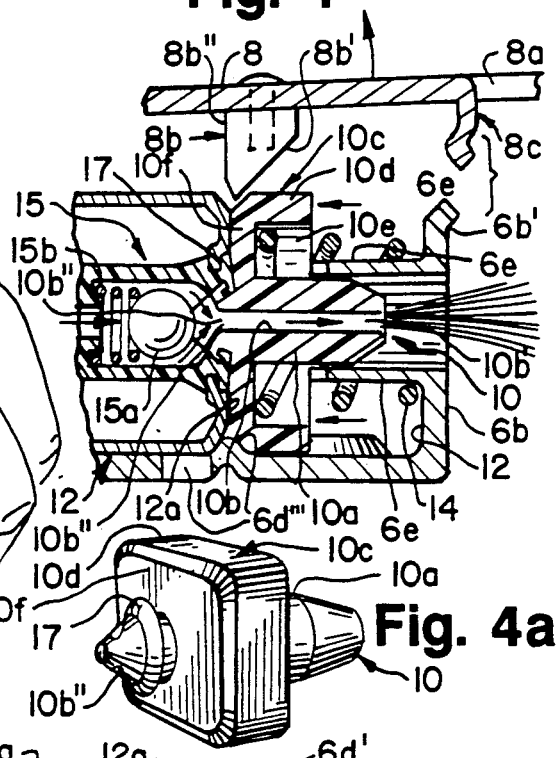
Fig. 4a
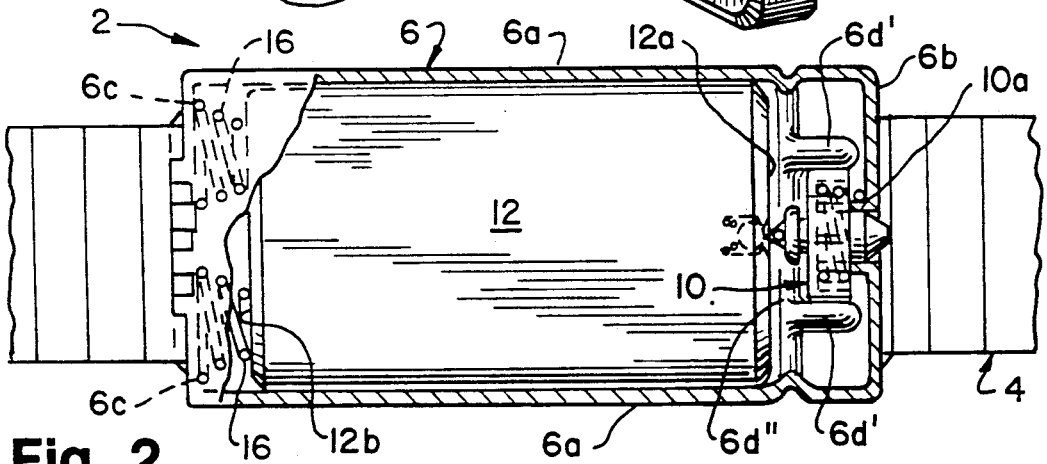
Fig. 2
Fig. 3
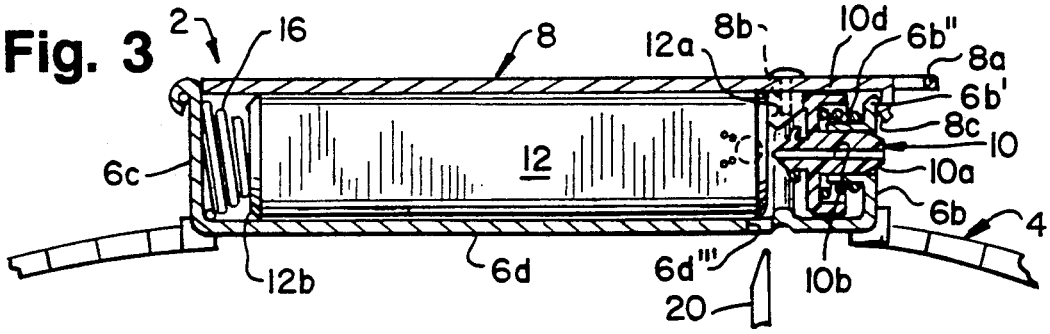

Fig. 5
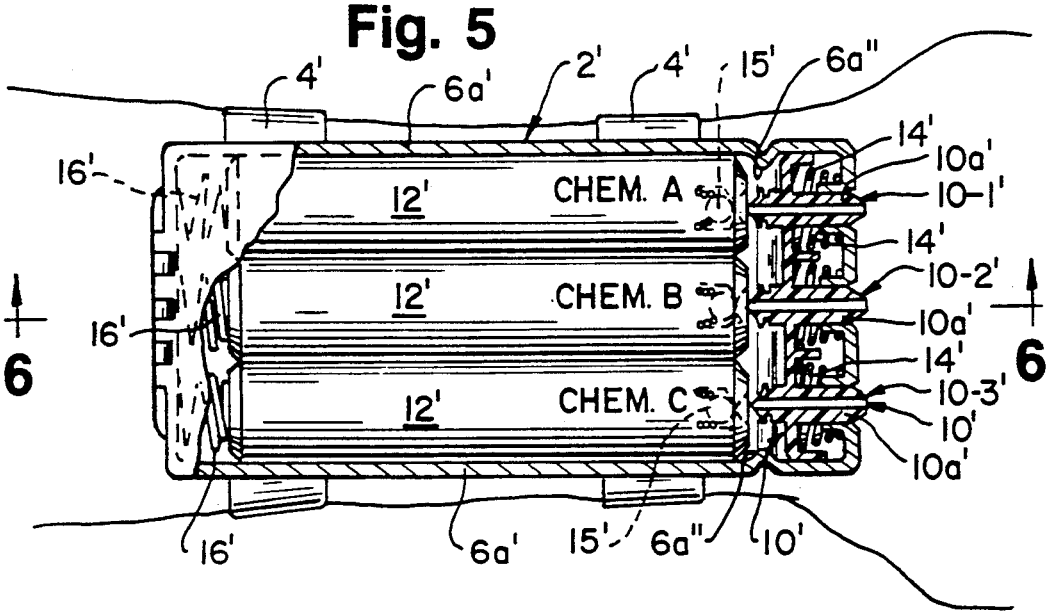
Fig. 6
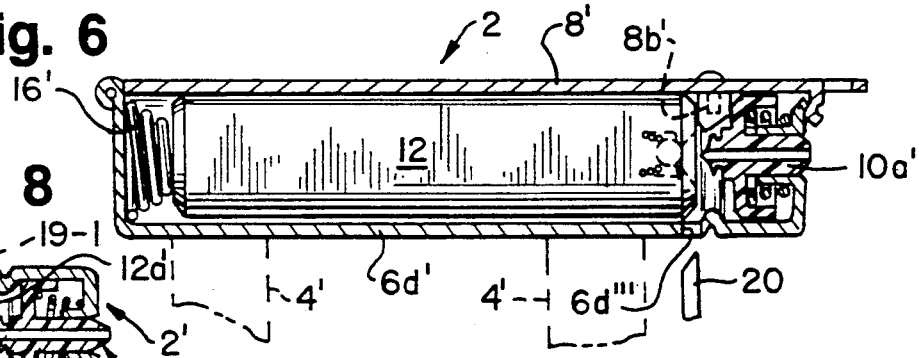
Fig. 8
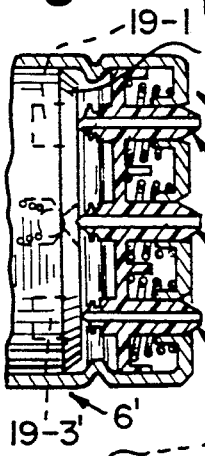
Fig. 9
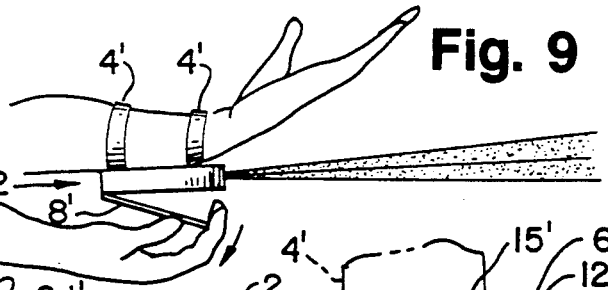
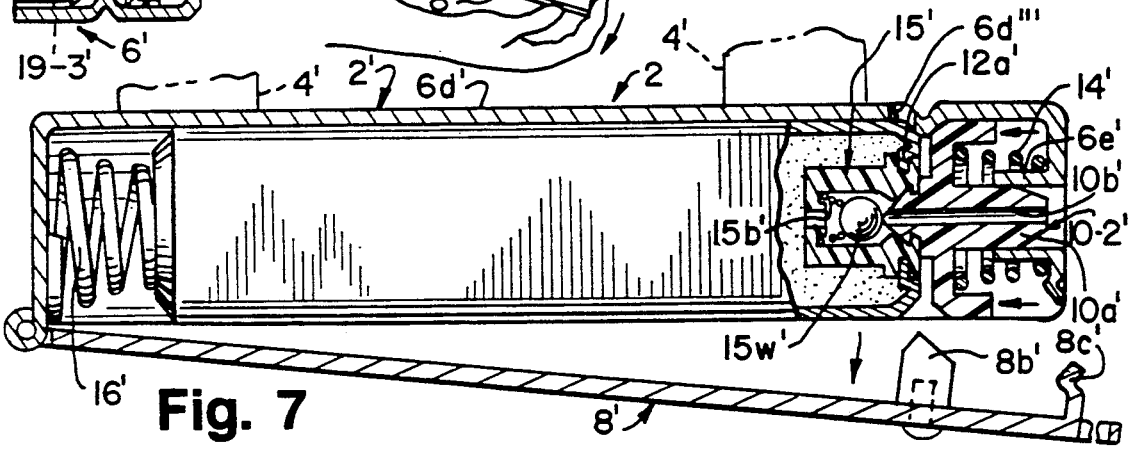
Fig. 7

Fig. 10
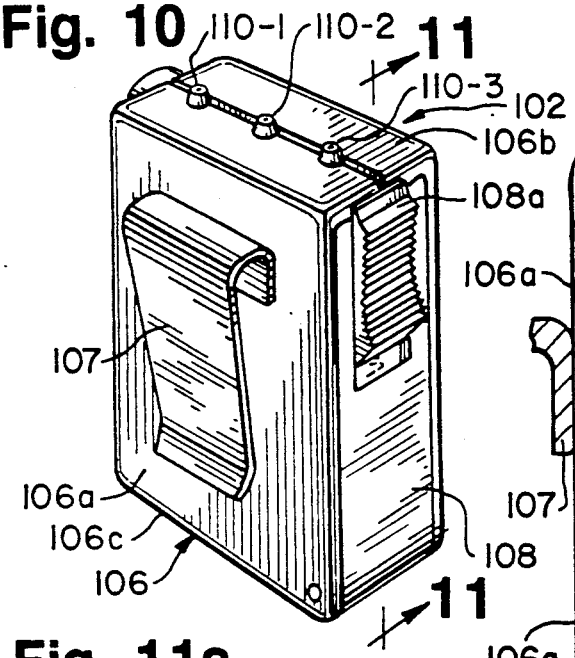
Fig. 14
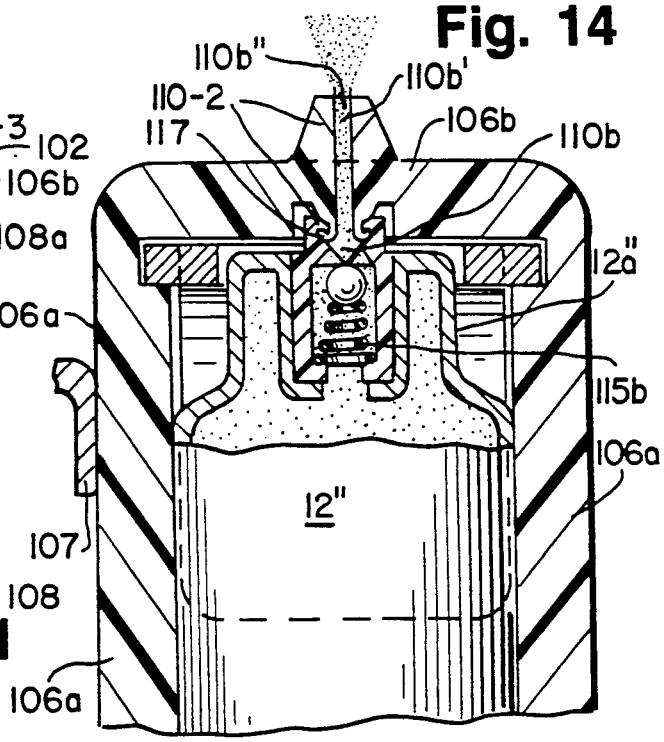
Fig. 11a
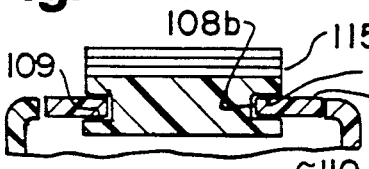
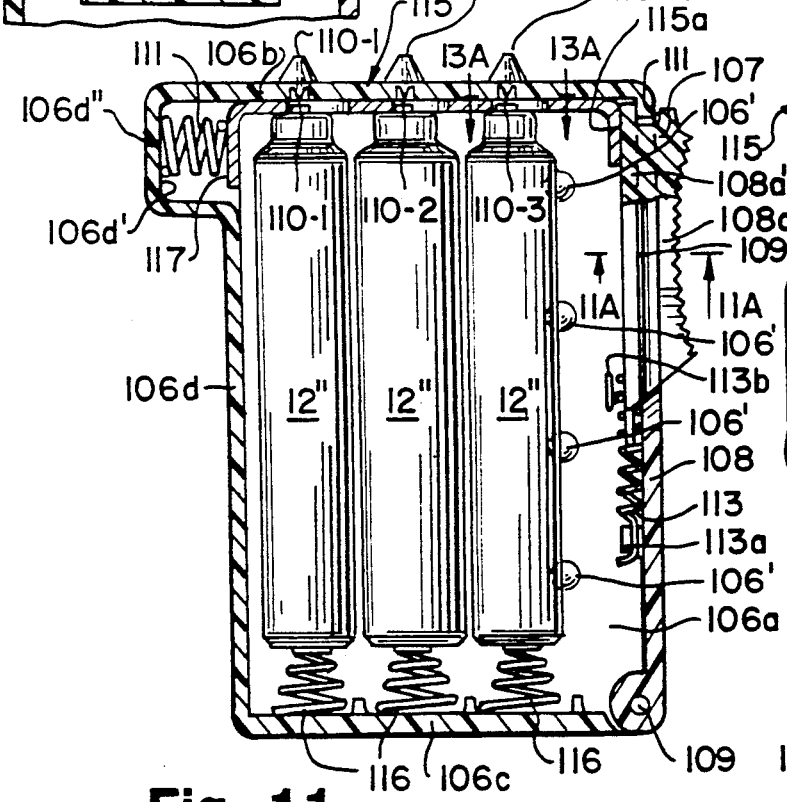
Fig. 11
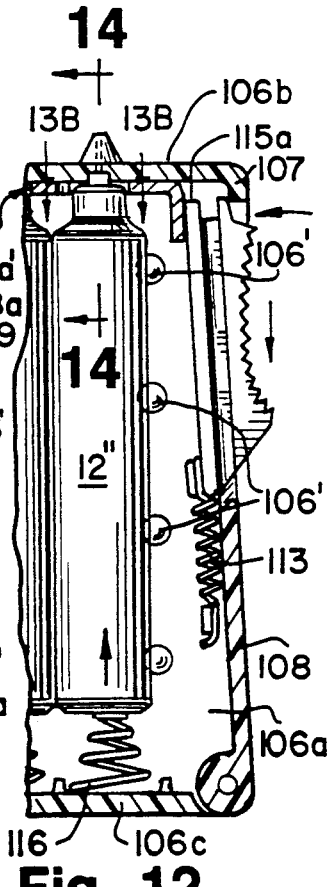
Fig. 12

Fig. 13a
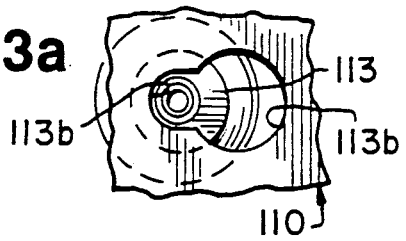
Fig. 15
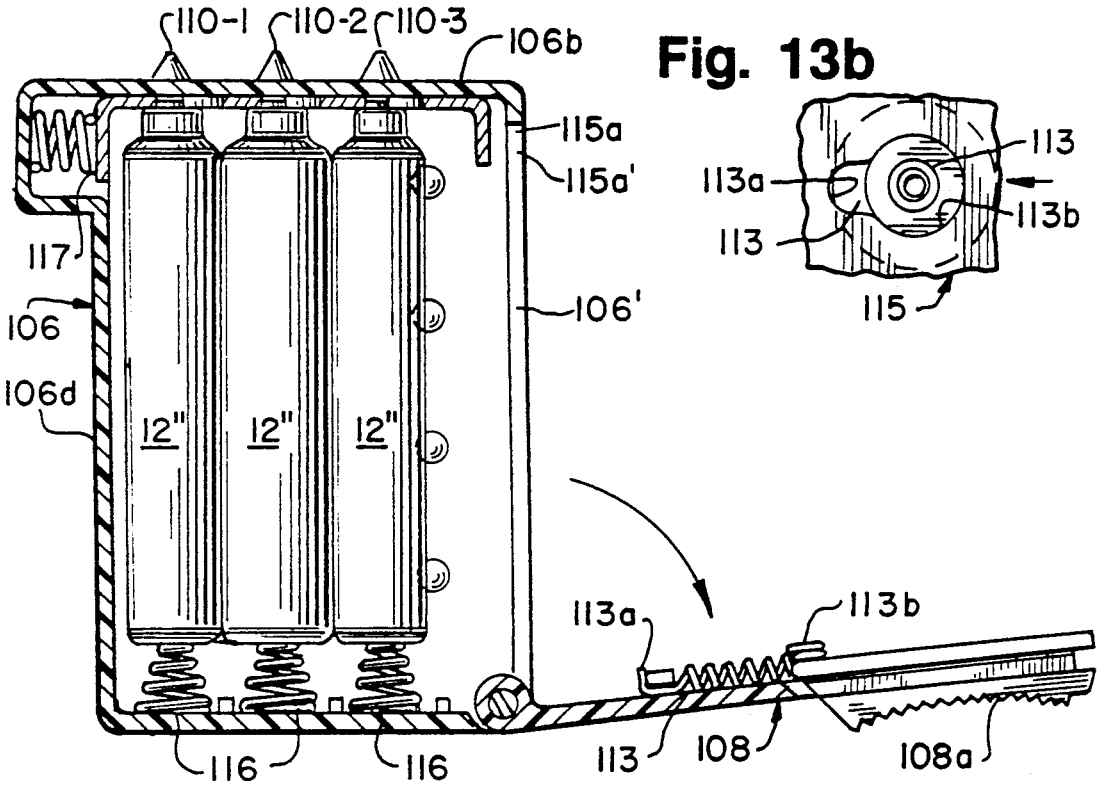
Fig. 13b
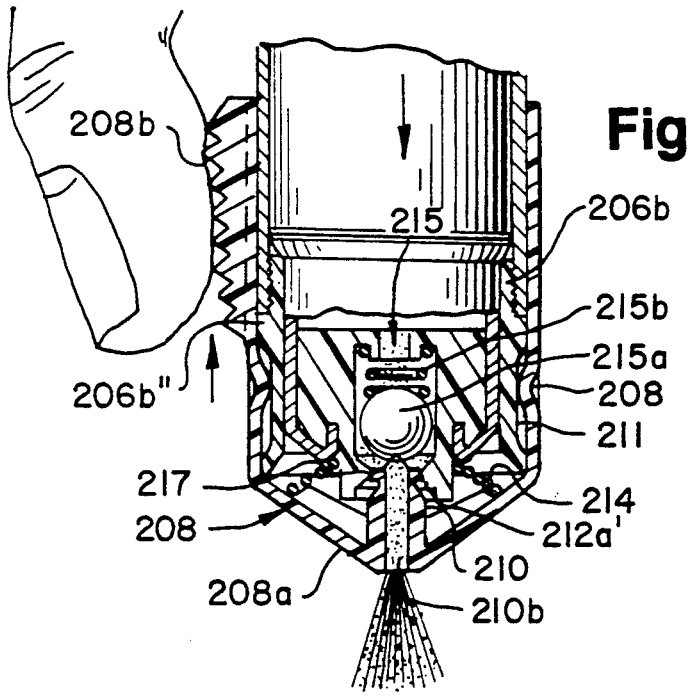
Fig. 19

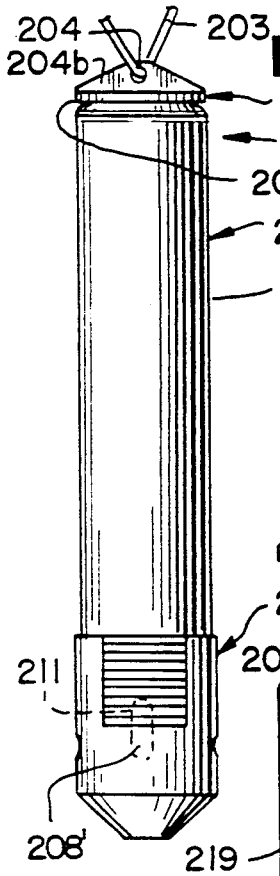
Fig. 16
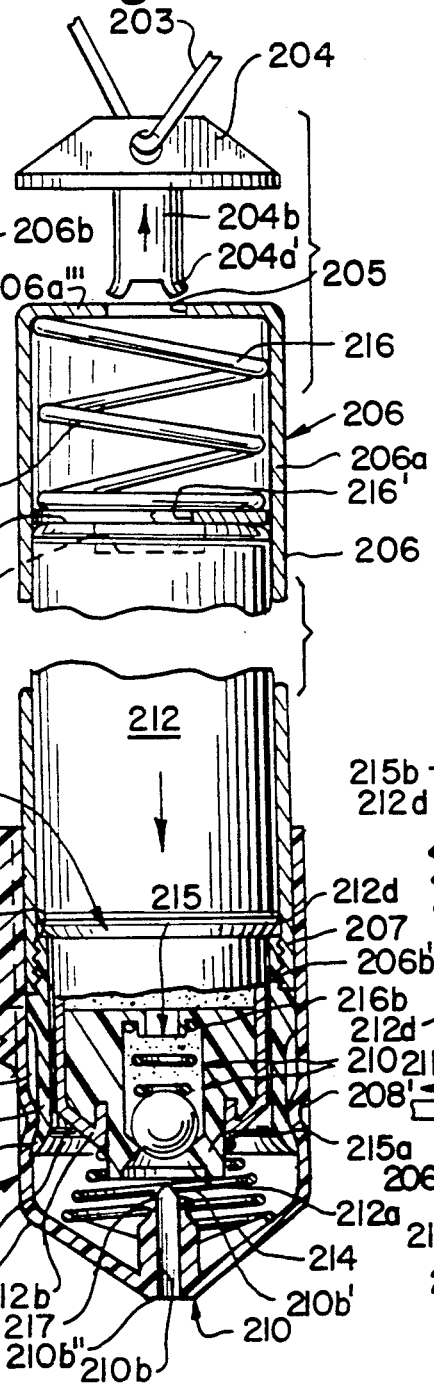
Fig. 18
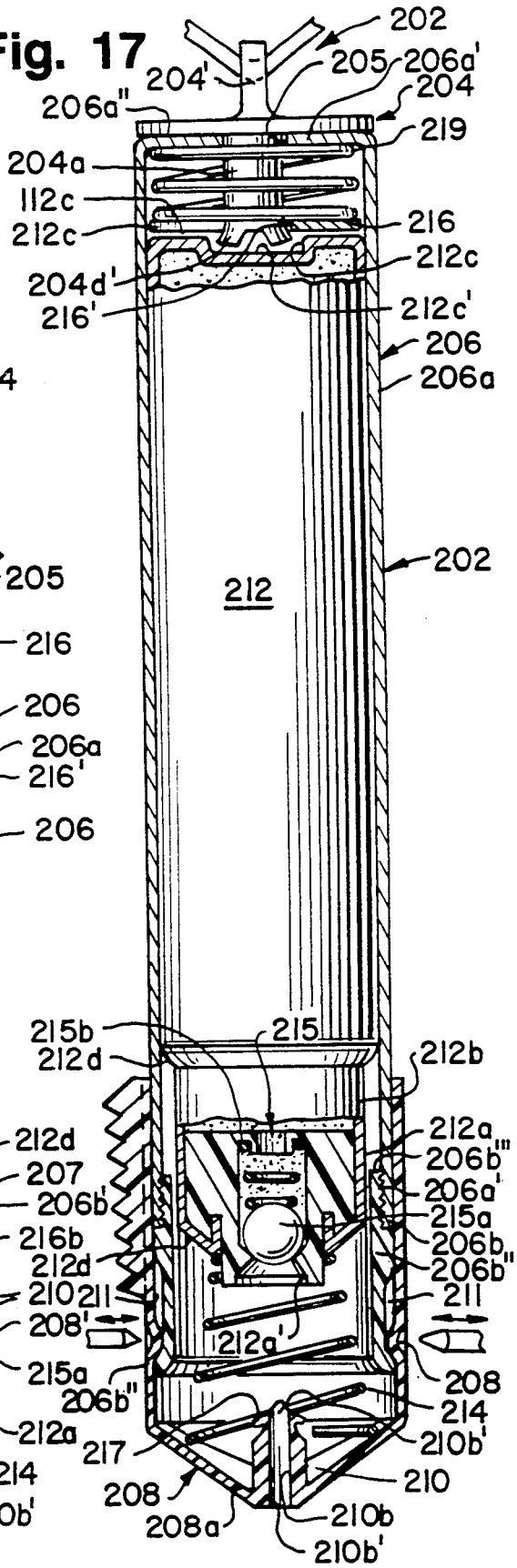

ATTACK-REPELLENT DEVICE

DESCRIPTION

1. Technical Field

The present invention relates to a portable attack-repellent chemical dispensing device to ward off potential attackers. It includes a housing which carries a supply of a pressurized fluid and at least a source of one attack-repellent chemical, although three are preferred, namely an indelible dye, a powerful chemical scent like artificial skunk oil, and an irritating material, like mace.

2. Background Prior Art

The prior art has proposed numerous attack-repellent chemical dispensing devices. Some are devices which are supported on the user's wrist and appear like a wristwatch; others are supported on or form part of a belt or necklace or appear as a piece of jewelry. The device usually includes an operating means to be grasped by the user and operated into a position where the attack-repellent chemical is ejected under pressure from the device.

Once such device is disclosed in U.S. Pat. No. 4,308,976, granted Jan. 5, 1982. It is constructed in the form of a belt with operating strings which when pulled by the user, causes a needle to puncture a container housing the attack-repellent material.

Another device is incorporated in a ring as shown in U.S. Pat. No. 4,061,249. Examples of attack-repellent devices which are carried on the wrist of the user are shown in U.S. Pat. No. 4,058,237; U.S. Pat. No. 4,241,850; U.S. Pat. No. 4,048,237, and U.S. Pat. No. 4,550,861.

These and other attack-repellent devices have left much to be desired from the standpoint of simplicity of construction, their proneness to accidental operation and the danger of the material spilling on the user's clothes or exposed skin. Most are not re-useable once operated, and they offer very little flexibility of choice by the user as to the particular chemicals to be used in the device.

The attack-repellent device of the present invention in its most preferred form overcomes most if not all of the aforesaid disadvantages. Thus, it is reliable, easy-to-use, flexible and simply constructed so that it can be manufactured at modest cost.

SUMMARY OF THE INVENTION

The present application discloses various forms of the invention; some are carried like a wristwatch on the arm of the user; others are supportably attachable to a belt or to a neck chain or necklace. The present invention is also applicable for insertion into the handle of a cane or umbrella. In each case, the user operable element which effects ejection of the chemical involved is designed to be easily operated by the user, but not prone to accidental operation.

In the form of the invention where the device is to be worn around the wrist of the user, the user operable member is most advantageously a member which must be pulled up by the user, so that the device will not be accidentally operated if the housing should brush or be pressed against an external object. In none of the various attack-repellent dispensing devices disclosed in the patents referred to is the user-operable members operated in this manner.

In the wrist supported form of the invention, the user-operable member preferably comprises at least part of the outer wall of the housing of the device which is pivotally mounted at one end and is releasably latched to the rest of the housing at the other end. When the need to use the device arises, the user can quickly operate the device by grasping the distal end of this wall and pulling it away from the housing. This is the preferred form of actuating member because the user has only to think of pulling on the actuating member, as compared to a situation where the operating member could be operated in one direction or another in a plane parallel to the surface of the body on which the device is mounted. The necessity of pulling on the member makes it difficult to accidentally operate by brushing the operating member against an external object. However, in some other forms of the invention, the device is actuated by a slide member movable parallel to a surface of the housing.

In accordance with another aspect of the invention, the nozzle which ejects the repellent chemical involved is positioned on the housing so that it is unlikely that the repellent chemical can drip upon or be directed toward the user. In the case where the device is supported on the user's wrist, the preferred orientation of the nozzle is one which directs the attack-repellent chemical transversely of the axis of the user's arm. The user must of course be aware of this orientation so he can position his arm to direct the repellent chemical emanating from the nozzle in the direction of the attacker.

In some forms of the invention, the device is not readily noticeable because of its small size. But in one form thereof, the device is of such a large size and is colored to be readily noticeable by a potential attacker, so that he will not be prone to attack a person carrying such a device. For example, in this form of the invention, the device could comprise a housing which is a large and unattractive rectangular box-like structure which is brightly colored and has an appreciable length in the direction of the axis of the user's arm. It is carried on the normally outer side of the arm. To simplify its construction, nozzles on the housing direct the chemical away from the user along the axis of the user's arm. To prevent the material from possibly dripping on the user's arm, the user rotates his arm so the palm of the hand faces upwardly and curved away from the housing supported on the side of his wrist then pointing toward the ground.

Another feature of the invention, which does not necessarily need to utilize the features previously described, is that the housing is uniquely designed as to receive two and preferably three attack-repellent chemical holding canisters filled by the supplier of the chemicals. The user can thus decide which selection of chemicals he wishes to use at a particular point in time. For example, one of the canisters can hold a source of a noxious chemical, another a source of an irritant like mace and another an indelible dye. In the alternative, he can select a single canister encompassing the overall size of three of the smaller canisters and containing one or all of these chemicals.

In accordance with a further feature of the invention, not necessarily used with the other features just described, although it is preferably so used, the one or more canisters involved are designed to be re-useable. To this end, each canister has a dispensing orifice behind which may be located a spring-urged ball valve or other valve means which will open to expose the interior of the canister when a valve operating projection forming part of a nozzle unit is forced into the orifice. When this projection is removed, the ball valve closes the orifice so that the remaining material may be used when a subsequent attack occurs.

Another feature of the invention most useful with the canister discharge orifice valve just described, is the use of a unique discharge nozzle construction wherein there is provided two or three spaced nozzle sections, each section comprising a passageway extending between an outer discharge orifice and an inner entry orifice. The inner end of each nozzle section forms a projection insertable into the discharge orifice of one of the smaller canisters described, hence the need for a number of nozzle sections. If only one large canister is used, the center nozzle section is preferably insertable into the single discharge orifice of the larger canister.

Independently of the number of nozzles used, in accordance with another feature of the invention, either and preferably both the nozzle and canister elements are mounted for movement, one relative to the other, between relatively spaced apart positions, where the projection of the inner end of each nozzle is withdrawn from the discharge orifice of the associated canisters, and a close or mating position where each nozzle projection penetrates the discharge orifice of the associated canister. The inner end of each nozzle preferably has means for sealing around the discharge orifice of the adjacent canister, so that the attack-repellent chemical will not leak around the orifice when the nozzle projection is mated with the discharge orifice of the associated canister.

Spring means are provided for urging the movable one or ones of the nozzle and canister into their mating position when released to do so. The movable one or ones of the nozzle and canister are held by suitable latching means in their spaced positions against the return force of the spring means. The latching means is released when the user operable member is moved to its active position.

In the case where the user operable member is a pivotable wall of the housing, the distal end of this wall has depending shoulder-forming means which keeps each nozzle and canister apart under the return force of the spring means, and a means for latching the user operable wall in a dormant position. Then, when the user operated member is pulled or otherwise operated into its active position, the depending shoulder-forming means is removed from between the nozzle and associated canister, so that the spring means forces the movable one or ones of the end nozzle and canister together, bringing together the projecting end of a nozzle and the discharge orifice of the associated canister.

The most reliable embodiment of the invention is an attack-repellent device comprising a pendant in the form of a small cylindrical housing or the like adapted to be attached to a neck chain. A special attaching means is used for attaching the housing of the pendant to the neck chain. The attaching means is designed so that the housing of the pendant can be released from the attaching means if the user pulls the pendant housing from the attaching means. Only then is the device armed to be operated by the user who can then operate a slide or other user-operated chemical release means to an operating position to release the repellent chemical. These and other features of the invention become apparent upon making reference to the specification, drawings and claims.

BRIEF DESCRIPTION OF DRAWINGS

FIG. 1 is a perspective view of one exemplary form of an attack-repellent device of the present invention which is supported on a wrist band surrounding the wrist of a user, and it shows in dashed lines the raising of the top cover of the housing of the device to initiate ejection of a propellent fluid and attack-repellent chemical through a single nozzle in a direction laterally of the user's arm;

FIG. 2 is a partially horizontal sectional view through the device of FIG. 1, taken along section plane 2—2;

FIG. 3 is a vertical sectional view through the device of FIG. 1, taken along section plane 3—3 and showing a slot in the bottom wall of the housing and a tapered tool insertable into the slot so as to prevent operation of the device when a canister is being inserted into or removed from the device;

FIG. 4 is a greatly enlarged, fragmentary vertical sectional view through the nozzle-containing end portion of the housing, showing the cover being raised to a position where the inner end of the nozzle is spring urged into mating relationship with the discharge orifice of a canister containing a propellent fluid and attack-repellent chemical, which is then forced through the exit orifice of the nozzle;

FIG. 4A is a perspective view of only the nozzle unit FIG. 4;

FIG. 5 is a partially horizontal sectional view of another and much larger form of the invention, where the device is supported around the arm of the user by a pair of securing straps, and wherein the device has smaller individual rather than a single large chemical holding canister as shown in FIGS. 1 through 4;

FIG. 6 is a vertical sectional view through the device of FIG. 5, taken along section plane 6—6, when the device is in its armed but dormant condition and showing a slot in the bottom wall of the housing and a tapered tool insertable into the slot so as to prevent operation of the device when canisters are being inserted into or removed from the device;

FIG. 7 is an enlarged view corresponding to FIG. 6 when the user has rotated his or her arm so that the device is inverted from its position shown in FIG. 6, and with the cover of the device pulled into its active position to cause the attack-repellent chemical to be discharged from the nozzles;

FIG. 8 is a fragmentary, sectional view of the nozzle end of the device of FIGS. 5–7, except that the three separate canisters shown in FIG. 5 have been replaced by a single larger canister;

FIG. 9 shows the device of FIG. 7 in its orientation as there shown, with the user bending his or her hand upwardly away from the device, to avoid contact of the dispensed chemical with the user's hand;

FIG. 10 is a perspective view of a form of the invention where the device is normally supported by a clip attached to the user's belt in an armed but dormant state;

FIG. 11 is a vertical sectional view through the device shown in FIG. 10, taken along section plane 11—11;

FIG. 11A is a sectional view through one side wall of the device, taken along section plane 11A—11A in FIG. 11 and showing a trigger slide mounted thereon;

FIG. 12 is a fragmentary vertical sectional view similar to FIG. 11, but showing the design in its operating state where a latching plate has been pushed by the trigger to permit canisters within the housing and nozzles to be brought into mating relationship;

FIG. 13A is a fragmentary horizontal sectional view through the housing of the device, taken along section line 13A—13A in FIG. 11, and showing the latching plate in its dormant, but armed position, preventing operation of the device;

FIG. 13B is a fragmentary, horizontal sectional view of the upper end of the housing of the device as shown in FIG. 12, taken along section plane 13B-13B after an operating slide has been pulled down to release the latching plate, to permit bottom arming springs to press the canisters upward against projections on the inner ends of stationary nozzles, to cause the pressurized attack-repellent chemical to be dispensed through the nozzles;

FIG. 14 is a greatly enlarged fragmentary, vertical, sectional view through FIG. 12, taken along section plane 14—14, showing the inner end of one of the nozzles penetrating the discharge orifice of one of the attack-repellent holding-canisters, so that the attack-repellent chemical is released under pressure and dispensed from the nozzle shown therein;

FIG. 15 is a view corresponding to FIG. 11 when an operating slide has been pulled down into a position to release the cover on which the slide is mounted for movement to fully open the housing, to permit the insertion of the canisters into or the removal of the canisters from the housing of the device;

FIG. 16 shows another form of the invention where the device is a pendant hanging from a neck chain and for safety reasons is unarmed until released from the chain;

FIG. 17 is an enlarged vertical sectional view through the device shown in FIG. 16;

FIG. 18 is a view showing the condition of the device when it has been pulled from connection with the neck chain which arms the device for operation; and FIG. 19 is a vertical sectional view corresponding to FIG. 18 when the user has operated a trigger slide to cause the attack-repellent chemical to be dispensed through the nozzle of the device.

DETAILED DESCRIPTION

While this invention can be made in many different forms, there is shown in the drawings to be described below various preferred embodiments of the invention. However, the broader aspects of the invention are not to be limited thereby, although they constitute various specific, preferred applications of the invention.

Embodiment of Invention Shown In FIGS. 1-4

The attack-repellent device 2 shown in FIGS. 1-4 comprises an arm band 4 of any suitable construction upon which is supported a shallow, rectangular-shaped, box-like housing 6. The housing 6 contains the various elements which perform the various functions to be described.

As illustrated, the housing 6 is elongated substantially in a direction laterally of the user's arm. It has longitudinal vertical side walls 6a—6a, a vertical nozzle-supporting lateral end wall 6b extending between corresponding ends of the walls 6a—6a, and a vertical lateral end wall 6c extending between the other ends of the longitudinal walls 6a—6a. The housing has a bottom wall 6d (FIG. 3) extending between the side walls 6a—6a and a top wall 8 which covers a recess through which the various elements to be contained in the housing are inserted when the device is assembled.

In the preferred form of the invention, the top wall 8 performs the function of a cover for the housing 6 and a user-operable trigger means. The trigger-forming cover 8 is pivotally mounted along the upper margin of the end wall 6c for movement between a completely opened position where the recess is fully exposed, and a closed condition shown best in FIG. 3. The trigger-forming wall 8 is spring-latched in a closed position in a manner to be described.

To activate the device, the user grasps the projecting distal end 8a of the trigger-forming wall 8 as shown in FIG. 3, and pulls upwardly to disengage a latch-forming depending projection 8c from a complementary latch-forming projection 6b' formed by the end wall 6b of the housing 6. The projection 6b' is an extension of a rectangular sleeve 6e projecting inwardly from the end wall 6b and having a cylindrical passageway in which a nozzle unit 10 is slidably mounted.

The nozzle unit 10 includes a cylindrical stem portion 10a projecting forward from a rectangular cup-shaped portion 10c and having a passageway 10b extending between an inlet orifice 10b' (FIG. 4) at its inner end and a discharge orifice 10b'' at its outer end. The cup-shaped portion 10c has an outer flange 10d projecting forwarding from an end wall 10f. The flange defines an outwardly opening annular recess 10e. A coil spring 14 in the recess extends between the end wall 10f of the cup-shaped portion 10c of the nozzle unit 10 and a wall surface 12 around the sleeve 6e of the housing end wall 6b.

When the trigger-forming cover 8 of the housing 6 is in its closed position, a pointed abutment shoulder-forming projection 8b depending from the cover 8 engages the nozzle end wall 10f to compress the spring 14. The shoulder-forming member 8b has an inclined camming surface 8b' as shown in FIG. 3 which, upon movement of the cover 8 to its closed position, engages a corner of the cup-shaped extension portion 10c of the nozzle unit and cams it to the right, as viewed in the drawings, to compress the spring 14.

Guide means are provided for guiding the movement of the nozzle unit 10. This guide means includes upwardly projecting ribs 6d'—6d' (FIG. 2) on the top surface of the bottom wall 6d. The ribs guide the flange portion 10d of the cup-shaped extension of the nozzle unit for movement longitudinally of the housing. The nozzle unit is retained in the housing between the longitudinal ribs 6d'—6d' by a traverse rib 6d'' formed in the housing wall 6a so that the stem 10a of the nozzle unit will not slide out of the interior of the housing sleeve 6e.

A canister 12 containing a propellent fluid and an attack-repellent chemical or chemicals is located within the housing 6. It is insertable into the housing through the housing entry recess normally closed by the trigger-forming cover 8. The canister 12 has an elongated rectangular shape, and is sized to just fit into the space within the housing defined between the longitudinal housing side walls 6a—6a. The L canister 12 has an outer end wall 12a as best shown in FIG. 4, to which is mounted a valve assembly 15 comprising a ball 15a and a coil spring 15b. The ball 15a is normally urged by the spring 15b to the right as viewed in the figure, to close a discharge orifice in the canister end wall 12a.

A pair of coil springs 16—16 are secured in a suitable manner to the housing end wall 6c, and are compressed by the L canister outer end wall 12b when the trigger-forming cover 8 is in its closed, latched position. In such case, a rear face 8b'' of the shoulder-forming projection 8b engages the canister outer end wall 12a. The shoulder-forming projection 8b is thus sandwiched between the end wall 10f of the cup-shaped portion 10c of the nozzle unit 10 and the canister end wall 12a, so as to compress both the latter springs 16—16 engaging the inner end wall of the canister 12 and the spring 14 which bears on the inner surface of the nozzle unit end wall 10f. When the trigger-forming cover 8 is closed, the device is armed under spring pressure for operation in the manner to be described.

In the armed condition of the device 2, it will be seen from FIG. 3 that the inner end of the stem 10a of the nozzle member is spaced from the discharge orifice of the canister 12. When the trigger-forming cover 8 is pulled upwardly to withdraw the shoulder-forming projection 8b from between the nozzle unit and the canister 12, the springs 16—16 and 14 will then operate to force the canister and the stem 10a of the nozzle together into mating engagement, so that the inner end of the stem 10a will then pass through the discharge orifice of the canister 12 to push the ball 15a inwardly as shown in FIG. 4. The mixture of a propellent fluid and the attack-repellent chemical will then be forced out the canister discharge orifice into the inlet orifice 10b' of the nozzle unit stem 10a. A seal-forming ring 17 (see FIG. 4A) projects from inclined surfaces forming the pointed inner end of the nozzle unit stem 10a, so that a seal around the canister discharge orifice is provided at the inner end of the stem 10a of the nozzle unit when the nozzle mates with the canister discharge orifice.

The nozzle unit 10 is positioned in the sleeve 6e of the housing end wall 6b so as to direct the attack-repellent chemical laterally of the user's arm, so that there is no danger of the chemical being directed towards any part of the user's body.

The attack-repellent device 2 of FIGS. 1—4 is a reusable device, since whenever the open cover 8 is reclosed, the device is re-armed for subsequent use. In order to insert a canister into the housing or remove a canister from the housing with the cover 8 in a fully open position, it is necessary to insert a suitable tool like 20 shown in FIG. 3 through a slot 6d''' in the bottom wall 6a. When this tool 20 is inserted, the canister 12 is held in a retracted position which compresses the spring 16.

Since the trigger-forming cover 8 is latched closed so that it must be pulled to activate the device, it is unlikely that the device will be accidentally operated should the housing be pushed against some object or wall surface. If desired, a key lock (not shown) may be added to the cover 8 and the housing interior, to lock the same closed in an unarmed condition unless its use is desired.

Embodiment of Invention Shown In FIGS. 5-9

The embodiment of FIGS. 5-9 is a wrist-mounted attack-repellent device 2' similar in many respects to that shown in FIGS. 1-4, except that this device is adapted to hold much larger volumes of the attack-repellent chemicals and the user is given flexibility as to whether he wants to utilize a single large canister 12, like that shown in FIGS. 2 and 3, or, in the alternative, smaller individual canisters 12', so that the user can more easily select which combination of chemicals are to be used at a given point in time. It has a large unattractive housing 6' elongated in the direction of the user's arm and can be brightly colored to be readily visible.

In the canister 12 in the FIGS. 1-4 embodiment, the canister can contain either a single repellent chemical, like mace, a noxious chemical, or an indelible dye, or a combination of these. By using individual canisters 12', the user can at will select three canisters to which contain the desired combination of chemicals.

To this end, a nozzle assembly 10' is provided which has three laterally-spaced nozzle sections 10-1', 10-2' and 10-3' in a housing 6', each nozzle section being substantially identical to the nozzle unit shown in the embodiment of FIGS. 1-4. To avoid needless additional description of this modified nozzle unit and other common elements present in the previously described device 2, similar reference numbers will be used to identify corresponding elements in the embodiment of FIGS. 5-9 except that a prime (') is sometimes added thereto.

Accordingly, each of the canisters 12' has a one-way spring-urged ball valve assembly 15' just like the one described in FIGS. 1-4. The nozzle assembly 10' and the canisters 12' are oriented at right angles to the orientation in the previously described embodiment 2. The discharge orifices of the three nozzle sections shown in FIGS. 5-9 are oriented in a forward direction, parallel to the axis of the user's arm. To avoid the possibility that the dispensed fluid will possibly be directed upon the user's hand when the attack-repellent device 2' is activated, the user must rotate his or her arm 180 degrees from the position in FIGS. 5 and 6 to that shown in FIGS. 7 and 9, so that the device is on the bottom side of the user's arm, where he can bend his hand upwardly to avoid any interference with the stream of fluid issuing from the nozzle discharge orifices.

In most other respects, the device 2' is similar to the device 2 previously described, and so the trigger-forming cover 8' of the housing 6' has shoulder-forming depending projections 8b' opposite each of the inner ends of the various nozzle sections, so that when the trigger-forming cover 8' is closed, each shoulder-forming member 8b' will be interposed between the inner end of each nozzle stem 10a' and the inner end of the associated canister 12'. Since there are three canisters in this form of the invention, a separate spring 16' is mounted opposite the inner end of each of the canisters 12', and there is a separate nozzle arming spring 14' associated with each nozzle section of the nozzle assembly 10'. The cover 8' is latched closed by a latching projection 8c' engaging a housing end wall latch-forming projection 6b'.

As shown in FIG. 6, the bottom wall 6a' of the housing has a slot 6a''' for receiving a tool 20 to hold replaceable canisters 12' in a retractable position within the housing when the cover 8' of the device is open.

It should be apparent that when the trigger-forming cover 8' is pulled downwardly away from the rest of the housing 6', the springs 16' and 14' will force the inner ends of the nozzle sections 10-1', 10-2', and 10-3' and the outer ends of the canisters 12' toward one another, so that the discharge orifices in the outer ends of each of the canisters will be penetrated by the pointed inner ends of the nozzle stems 10a', to cause the propellent and attack chemical involved to be forced through the passageways of the various nozzle sections.

Another difference between the attack-repellent device 2' and the unit 2 is that the nozzle assembly 10' is guided for longitudinal movement in the housing 6' by the longitudinal walls 6a'—6a' of the housing 6', as best shown in FIG. 5. The housing walls 6a'—6a' also have transverse ribs 6a'' for retaining the nozzle assembly 10' over the sleeves 6e'—6e'—6e' which slidably receives the stems of the nozzles 10-1', 10-2' and 10-3'. Another difference is that a pair of wrist bands 4'—4' are used to securely fasten the much longer housing 6' to the wrist of the user's arm.

If it is desired to utilize a single canister having the same overall size as the three canisters 12', the modified canister 12'' as shown in FIG. 8 may be used in the housing 6'. The canister 12'', has an outer wall 12a' with a single central discharge orifice adapted to receive the projecting inner end of the stem 10a' of the center nozzle section 10-2. Depressions 19-1 and 19-3 are provided in the canister end wall to provide clearance for stems 10a' of nozzle sections 10-1 and 10-3 when the nozzle assembly and the canister is spring pressed into mating relationship with the canister discharge orifice when the trigger-forming cover 8' is pulled away from the housing 6'.

Embodiment of Invention Shown In FIGS. 10–15

The attack-repellent device 102 shown in FIGS. 10–15 is one designed to be normally carried on the user's belt. Accordingly, it includes a housing 106 with a belt clip 107 adapted to secure the housing 106 to the user's belt. This housing has top and bottom walls 106b and 106c, a lefthand side wall 106d, a trigger member-carrying cover-forming wall 108 and main side walls 106a—106a. The wall 108 is pivotally supported at 109 to the front end of the bottom housing wall and normally covers an entry recess 106' (FIG. 15) into the housing 106.

Slidably disposed on the cover-forming wall 108 (FIGS. 11 and 11A) is a trigger-forming slide 108a. The trigger-forming slide has guide slots 109 which receive the defining walls of an aperture 108b formed in the wall 108. Depending from the bottom front end of the top housing wall 106b is a depending lip 107 which fits into a groove 111 in the top of the slide when the slide is in its uppermost position. The slide then abuts against a flange 115a of a movable latching plate 115. A spring 113 anchored between the wall 108 at 113a and the slide at 113b urges the slide upward within the cover aperture 108b.

The rear end of the latching plate 115 has a depending shoulder-forming wall 117 against which bears a coil spring 111 sandwiched between this shoulder-forming wall 117 and the inner surface 106d' of a projecting portion 106d'' of the inner wall 106d of the housing 106. Thus, when the trigger-forming slide 108a is pulled downwardly so that it slips by the bottom of the lip 107. The slide 108a can be pushed against the flange 115a to compress the spring 111 further, to permit operation of the device in a manner to be explained.

When the slide 108a is in the lowered position, the cover-forming wall 108 can be pivoted to a completely open position exposing the entry recess 106' into the housing 106', as shown in FIG. 15. Canisters 12''—12''—12'' containing the attack-repellent chemicals are then insertable into the housing through this recess 106' where they are laterally held in place by positioning bosses 106' projecting from one of the side walls 106a. The canisters are supported in vertical orientations between springs 116—116—116 secured to the bottom housing wall 106c and the latching plate 115.

As best shown in FIG. 14, integrally molded or otherwise attached to or formed on the housing top wall 106b are three nozzle-forming projections 110-1, 110-2 and 110-3. Each of these nozzle-forming projections has a passageway 110b extending between an outer discharge orifice 110b'' at the outer end thereof and an inlet orifice 110b' formed on the pointed end of a downwardly extending valve-operating projection 110-1', 110-2' or 110-3' having the same shape and construction as the inner ends of the nozzles of the previously described embodiments of the invention. Thus, each of these projections has a seal-forming ring 117 which forms a seal around the discharge orifice of the associated canister 12'' when it is inserted therein.

The canisters 12'' differ from the small canisters 12' previously described in that they each have an upwardly projecting reduced neck portion 12a'' which forms a shoulder against which the latching plate 115 can bear to hold the canisters against the individual compressed coil springs 116—116—116. The latching plate 115 has opposite each of the nozzle-forming projections 110-1, 110-2 and 110-3 a keyway-shaped aperture 113 (see FIGS. 13A and 13B). The keyway-shaped aperture 113 has a large aperture section 113a communicating with a small aperture section 113b. When the slide 108a is in its upper most position, each smaller aperture section 113b is opposite the tapered neck portions of the associated canister 12'' so that the upper ends of the canisters are held from the latching plate in a compressed condition. When the slide 108a is lowered into a position below the housing lip 107, and the user pushes the slide inwardly to bring the center point of each larger aperture section 113a opposite the center of the associated canister, the neck portion of each canister passes through the associated larger aperture section of the merging plate to bring the discharge orifice of the associated canister over the inner pointed end of the associated nozzle projection 110-1', 110-2' or 110-3'. Each projection depresses the associated one-way valve ball 115a against the associated spring 115b (see FIG. 14), which causes the interior of the canister involved to communicate with the discharged passageway 110b of the associated nozzle.

A disadvantage of the attack-repellent device 102 over those previously described is that it is possible by brushing the trigger-forming slide 108a against an external surface that the slide can be moved accidentally into a position which will activate the attack- repellent device. However, because the device is normally carried on the user's belt, it is unlikely that the device will engage another surface in a manner to activate it, unlike a forms of the invention which is carried on the user's wrist.

Embodiment of Invention Shown In FIGS. 16–19

The embodiment of the invention shown in FIGS. 16–19 comprises a pendant 202 secured to a neck chain or necklace 203 which passes through an eyelet 204' projecting from a circular pendant mounting disc 204. The mounting disc 204 has a depending stem 204a.

The stem 204a passes through an aperture 205 (FIG. 18) in the top wall 206a'' of a main cylindrical housing body 206a of a vertically elongated cylindrical housing assembly 206. The housing body terminates at its bottom end 206a' in an internally threaded portion 207 which threadingly receives the externally threaded portion 206b' of a lower cylindrical housing section 206b. The lower cylindrical housing section 206b has an outwardly flared bottom end 206b'' defining a shoulder against which an inwardly projecting dimples 208'—208' of an open-top cylindrical trigger-forming slide member 208 bear under both the force of gravity and that of a normally compressed coil spring 214. The dimples 208'—208' ride in vertical grooves 211—211 formed in the lower housing section 206b.

The upper end of the spring 214 bears against the end of the reduced bottom end portion 212b of a cylindrical canister 212 containing a mixture of a suitable propellent and one or more attack-repellent chemicals. The bottom end of the coil spring 214 bears against a downwardly extending tapered wall 208a at the bottom end of the cylindrical slide member 208. The wall 208a terminates at a nozzle-forming projection 210 which extends upwardly from the tapered wall 208a. The nozzle 210 has a vertical discharge passageway 210b extending between a discharge orifice 210b'' at its outer end and an inlet orifice 210b' at its pointed inner end. This pointed inner end has a seal-forming ring 217 to make sealing engagement around the discharge orifice 212a' at the reduced bottom end 212b of the canister 212.

The coil spring 214 urges the canister 212 to an upper position where the canister top wall 212c abuts the bottom of an apertured washer 216. The canister top wall 212c has a recess 212c' which receives the outwardly flared bottom end 204a' of the depending stem 204a of the mounting disc 204 which stem passes through the aperture 216' in the washer 216. This outwardly flared stem end holds a coil spring 219 compressed between the apertured washer 216 and the apertured upper wall 206a'' of the housing body 206a. The pendent attack-repellent device 202 now being described is in a normally unarmed state when it is secured to the neck chain 203, so that the device cannot be readily accidentally operated.

To arm the device, the user must pull the device 202 from connection with the stem 204a of the mounting disc 204 by grasping the pendant housing 206 and pulling the pendent downwardly so that the outwardly flared bottom end 204a, of the stem 204a will slip through the aperture 216' of the washer 216 as shown in FIG. 18. Then the coil spring 219 at the top of the canister 212, Which is stronger than the coil spring 214 at the bottom thereof, will push the canister 212 downwardly to a point where an annular shoulder 212b at the junction of the reduced portion 212d of the canister 212 and the rest of the canister 212b bears upon the upper end 206b''' of the bottom housing section 206b as shown in FIG. 18.

The slide member 208 can be moved along the housing 206 only for a limited distance because the flanged portion 206b'' of the lower housing section 206b acts as a stop shoulder when the annular rib 208' of the slide member 208 reaches the same. The pointed inner end of the nozzle 210 cannot reach the discharge orifice of the canister 212 until the canister is in its lowered position which arms the device for operation.

To operate the armed device, the user grasps the knurled portion 208b of the slide 208 and pulls on the slide 208b against the force of the expanded spring 219 to bring the pointed end of the nozzle 210 into the discharge orifice 212a' of the canister 212, where a ball valve assembly 215 of the canister is located. The pointed end of the nozzle of the slide depresses the ball 215a against the associated coil spring 215b, to cause the repellent chemical to be dispensed through the discharge orifice 210b'' of the device 202.

The assembly procedure for fabricating the attack-repellent device 202 now being described includes the initial assembly of the pendent mounting disc 204 with the main housing body 206a, before the canister 212, the lower housing section 206b and the slide 208 have been assembled with the main body 206a of the pendent housing 206. Initially, the mounting disc 204 is assembled with the main housing body 206a by inserting the stem 204a thereof through the aperture 205 in the upper end wall 206a'' of the housing 206 before the bottom end of the stem has been flared. The coil spring 219 is then inserted over the stem, and the apertured washer 216 is then applied over the spring and pressed against the spring to compress the same. The outer end of the stem 204a is then flared so that the washer 216 holds the spring 219 in its compressed condition.

Next, the canister 212 is inserted i within the main housing body 206a, following which the lower housing section 206b is fully threaded within the bottom threaded portion of the main housing body 206a. The flanged portion 206b'' of the lower housing section 206b then engages the bottom end of the main housing body 206a. The coil spring 214 is then placed within the open upper end of the cylindrical slide before the slide is placed over the lower housing section 206b. This assembly of the slide and spring is then inserted over the lower housing section 206b and is positioned so that the spring 214 is compressed to a given desired degree. Then the dimples 208'—208' are formed on the cylindrical slide by a suitable tool immediately beyond the flared bottom end 206b'' of the lower housing section 206b, so that the slide cannot drop off of the bottom of the housing 206.

It is apparent that the various forms of the invention provide a reliable, easy to use and economically to make device for dispensing an attack-repellent chemical when incorporated in a variety of different housing configurations.

While the invention has been described with reference to several preferred embodiments, it will be understood by those skilled in the art that various changes may be made and equivalents may be substituted for elements thereof without departing from the broader aspects of the invention. Also, it is intended that broad claims not specifying details of a particular embodiment disclosed herein as the best mode contemplated for carrying out the invention should not be limited to such details. Furthermore, while, generally, specific claimed details of the invention constitute important specific aspects of the invention in appropriate instances even the specific claims involved should be construed in light of the doctrine of equivalents.

We claim:

1. In an attack-repellent device comprising: a housing to be attached to the user, a container in said housing for holding a supply of an attack-repellent chemical and a pressurized fluid for dispensing said chemical under pressure from the device, an nozzle on said housing for directing the pressurized chemical in a direction away from the user to impinge upon the attacker; user operated chemical release means operable from an initial dormant condition to an active chemical release condition, and means responsive to the operation of said user operable means to said active condition for feeding said pressurized attack-repellent chemical to the nozzle for dispersal; releasable attaching structure for attaching said housing to the user, said device being unarmed and incapable of use when attached by said attaching structure to the user, said attaching structure including a section responsive to the user moving said housing away from said attaching structure for releasing the housing therefrom; and mechanism responsive to the detachment of said housing from said attaching structure for arming the device so that operation of said user operated chemical release means to said active condition will then result in the feeding of said attack-repellent chemical through the nozzle of the device, the improvement wherein said housing includes a canister for holding a propellent fluid and an attack-repellent chemical, said releasable attaching structure includes a member attached to the upper end of the housing, said member including a stem which depends through an aperture in said upper end of said housing, and a washer in said housing through with the stem passes, the end of the stem being spread outwardly to retain the washer on the flared bottom end of the stem; and said housing including a first spring compressed between said washer and the upper end of said housing; said user operated chemical release means being an open top slide member applied over the bottom end of said housing, said open top slide member being raisable with respect to the bottom end of said housing, a second spring compressed between the bottom end of said open top slide and the bottom of said canister to hold said canister in a raised position; said canister having a discharge orifice in the bottom thereof and a one-way valve normally closing said discharge orifice; and there being formed on the bottom of said slide member an upwardly projecting nozzle-forming projecting adapted to be inserted within said discharge orifice of said canister to open said valve to cause the propellent and chemical within said canister to be fed through said nozzle-forming projection only when said device is armed and said slide member is pulled toward said canister; and shoulder forming means on the bottom of said housing for engaging a portion of said canister when said canister is forced into a lowered position by said first spring means when said flared bottom end of said stem of said detaching means is removed from said washer aperture, to arm the device when the user pulls down upon said housing, said first spring then expanding to press said canister down to said lowered position where it bears on said shoulder-forming means on the bottom of said housing, thereby to position the bottom of the canister in a position where the movement of said slide member can bring the inner end of said nozzle-holding projection within said discharge orifice.

2. In an attack repellent device including a housing for attachment to a user's body or article carried by the user, a dispensing nozzle in said housing for dispensing an attack-repellent chemical, a storage section for holding a supply of an attack-repellent chemical and propellant fluid therefor which can force said chemical under pressure through said dispensing nozzle means, and user operable trigger mechanism operable between dormant and active conditions, the improvement comprising: at least one of said nozzle and storage section being mounted for movement relative to the other between a first position where they are relatively spaced apart and a second position where they are in close relation; a first spring for urging one of said nozzle and storage sections toward and into said second position; a latch for establishing latching engagement with said nozzle and storage sections in said first relatively spaced apart positions against the urging force of said spring; and said latch releasing from said latching engagement in response to operation of said trigger to said active condition to permit said spring to position said nozzle and storage section in said close relation and for causing said propellant fluid and attack-repellent chemical to be directed through said nozzle; and said latch being a member movable between a latched position where said nozzle and storage sections are held in said first spaced apart position and an unlatched position where said spring urges said nozzle and storage sections into said close position, a second spring for urging said latch into said latching position, and said user operable trigger being positioned for urging said latch from said latched to said unlatched position against the force of said second spring when said user operable trigger is moved from said dormant to said active position.

3. The device of claim 2 wherein said user operable trigger in said dormant condition is in a retracted position on said housing and is operable into said active position by depressing the same.

4. The attack-repellent device of claim 3 wherein said storage section is a container, said latch is an apertured member which holds said nozzle and container apart when in said latched position and has an aperture through which said container can pass to make a mating engagement with said nozzle under the urging force of said first spring when said latch is in said unlatched position.

5. In an attack-repellent device to be worn on the user's wrist, the device having an arm band for securement around the wrist of the user, a housing carried on the outside of said armband, a dispensing nozzle on said housing for dispensing an attack-repellent chemical to the exterior thereof; holding means in said housing for receiving a supply of said attack-repellent chemical and a propellant fluid for forcing said attack-repellent chemical through said nozzle means, the improvement wherein: said holding means is at least one container in said housing including a dispensing orifice normally sealed by a one-way valve which normally close said dispensing orifice but when opened permits the attack-repellent chemical and said propellant fluid to flow out of said orifice; said dispensing nozzle having on the inner end thereof an inlet orifice adapted to be brought into communication with said dispensing orifice of said container; a user operable trigger comprising a cover panel on said housing covering a recess in the housing and into which said container can be placed into or removed from the housing, said cover panel being normally held in a dormant position said housing covering said recess and being movable into a position where said recess is exposed for inserting of said container means into said housing, said cover panel also being movable by the user into an active position; and means responsive to movement of said cover panel into said active position for bringing said inlet orifice of said dispensing nozzle into communication with said discharge orifice of said container and for opening said one-way valve to cause the propellant fluid and attack-repellent chemical to pass into said nozzle to be dispensed therefrom.

6. The attack repellent device of claim 5 wherein said nozzle means is placed in said housing so as to direct the dispensed pressurized fluid and attack chemical in a direction to one side of the user's arm.

7. The attack repellent device of claim 5 wherein said housing is supported on said arm band in a position to direct the pressurized fluid and attack chemical in a direction parallel to the user's arm and in a direction away from the user, said housing being a substantially elongated in a direction parallel to the user's wrist, and there being at least a pair of said arm bands longitudinally spaced for securely anchoring the housing to the user's arm.

8. An attack repellent device comprising: a housing to be attached to the user, container-receiving in said housing for holding a supply of an attack-repellent chemical and a pressurized fluid for propelling said chemical under pressure from the device; nozzle means on said housing for directing the pressurized chemical in a direction away from the user to impinge upon the attacker; user operated chemical release means operable from an initial dormant condition to an active chemical release condition, and means responsive to the operation of said user operable means to said active condition for feeding said pressurized attack-repellent chemical to the nozzle means for dispersal; the improvement comprising:

said nozzle means being at least two spaced nozzles having a passageway extending therethrough between a chemical inlet orifice at the inner end thereof and a discharge orifice at the outer end thereof;

said container-receiving means in said housing holding either one large container or at least smaller containers to contain pressurized fluid and the repellent chemical; each container having an attack chemical discharge portion to receive the inner end of one of said nozzles to make communication with the interior thereof when the nozzle and container are brought together;

said housing having a container insertion recess and a removable cover for the recess for permitting the insertion into or removal from said recess of a selected one or more of said containers from the housing; and means responsive to the operation of said user operable release means to said active condition for bringing the inner end of one of said nozzles into communication with the interior of said large containers or the interior of each of said smaller containers at the location of said discharge portion thereof for discharging said propellent fluid and attack-repellent chemical through the associated nozzle.

9. The attack repellent device of claim 8 wherein said housing contains means for supporting said one or more containers for movement between a first dormant position where an end with discharge portions thereof is spaced from the inner ends of one of said nozzles, and where said discharge portions thereof are contiguous to the inner ends of one of said nozzles, so that one or more of said nozzles can make communication with the interior of said one or more containers; resilient means for urging said one or more containers and the inner end of said nozzles together, releasable latching means for holding said one or more containers in said dormant position against the return force of said spring means; and means responsive to the operation of said user operable release means to said active condition for unlatching said latching means so said spring means can urge said containers and inner ends of said nozzles together.

10. In an attack-repellent device including a hosing for attachment to a user's body or article carried by the user, a dispensing nozzle in said housing for dispensing an attack-repellent chemical, a storage section for holding a supply of an attack-repellent chemical and propellant fluid therefor which on force said chemical under pressure through said dispensing nozzle means, and user operable rigger mechanism operable between dormant and active conditions, the improvement comprising at least one of said nozzle and storage section being mounted for movement relative to the other between a first position where they are relatively spaced apart and a second position where they are in close relation; spring means for urging one of said nozzle and storage sections toward and into said second position; a latch for establishing latching engagement with said nozzle and storage sections in said first relatively spaced apart positions against the urging force of said spring; and said latch releasing from said latching engagement in response to operation of said trigger to said active condition to permit said spring to position said nozzle and storage section in said close relation and for causing said propellant fluid and attack-repellent chemical to be directed through said nozzle; and both of said nozzle and storage section being mounted for movement, one toward the other, said spring means including separate springs for respectively urging said nozzle and storage sections together.

11. In an attack-repellent device including a housing for attachment to a user's body or article carried by the user, a dispensing nozzle in said housing for dispensing an attack-repellent chemical, a storage section for holding a supply of an attack-repellent chemical and propellant fluid therefor which can force said chemical under pressure through said dispensing nozzle means, and user operable trigger mechanism operable between dormant and active conditions, the improvement comprising: at least one of said nozzle nd storage section being mounted for movement relative to the other between a first position where they are relatively spaced apart and a second position where they are in close relation; a first spring for urging one of said nozzle and storage sections toward and into said second position; a latch for establishing latching engagement with said nozzle and storage sections in said first relatively spaced apart positions against the urging force of said spring; and said latch releasing from said latching engagement in response to operation of said trigger to said active condition to permit said spring to position said nozzle and storage section in said close relation and for causing said propellant fluid and attack-repellent chemical to be directed through said nozzle; and said user operable trigger carries a part of said latch and in said active position latches said nozzle and storage sections in said relatively spaced apart position.

12. In an attack-repellent device including a housing for attachment to a user's body or article carried by the user, a dispensing nozzle in said housing for dispensing an attack-repellent chemical, a storage section for holding a supply of an attack-repellent chemical and propellant fluid therefor which can force said chemical under pressure through said dispensing nozzle means, and user operable trigger mechanism operable between dormant and active conditions, the improvement comprising: at least one of said nozzle and storage section being mounted for movement relative to the other between a first position where they are relatively spaced apart and a second position where they are in close relation; a first spring for urging one of said nozzle and storage sections toward and into said second position; a latch for establishing latching engagement with said nozzle and storage sections in said first relatively spaced apart positions against the urging force of said spring; and said latch releasing from said latching engagement in responses to operation of said trigger to said active condition to permit said spring to position said nozzle and storage section in said close relation and for causing said propellant fluid and attack-repellent chemical to be directed through said nozzle; and said user operable trigger in said dormant condition being in a retracted position on said housing and is operable into said active position by a pulling force of the user thereon.

13. In an attack-repellent device including a housing for attachment to a user's body or article carried by the user, a dispensing nozzle in said housing for dispensing an attack-repellent chemical, a storage section for holding a supply of an attack-repellent chemical and propellant fluid therefor which can force said chemical under pressure through said dispensing nozzle means, and user operable trigger mechanism operable between dormant and active conditions, the improvement comprising: at least one of said nozzle and storage section being mounted for movement relative to the other between a first position where they are relatively spaced apart and a second position where they are in close relation; a first spring for urging one of said nozzle and storage sections toward and into said second position; a latch for establishing latching engagement with said nozzle and storage sections in said first relatively spaced apart positions against the urging force of said spring; and said latch releasing from said latching engagement in response to operation of said trigger to said active condition to permit said spring to position said nozzle and storage section in said close relation and for causing said propellant fluid and attack-repellent chemical to be directed through said nozzle; and said container section includes at least one container containing said propellant fluid and one or more attack-repellent chemicals, each container being removable from said housing so that a fresh supply of said propellant fluid and attack-repellent chemicals in filled replacement containers can be inserted into the housing, and said nozzle being a permanent part of the housing so it is useable with the replacement containers.

14. The attack-repellent device of claim 10, 11, 12 or 13 wherein said latch is an apertured plate movable between a latched position where said nozzle and container section cannot be moved into their closed relation and an unlatched position where they can move to said close position, a second spring normally urging said latching plate into said latched position, and said user operable trigger when moved to said active position presses said latching plate into said unlatched position where an aperture in the plate permits said container section to move into close relation with said trigger.

15. The attack-repellent device of claim 13 wherein said housing is adapted to be attached to a belt of the user.

16. The attack-repellent device of claim 14 wherein there is provided means for holding the nozzle and container in said housing in spaced apart positions until said user operable means is moved to said active position.

17. The attack-repellent device of claim 16 wherein said holding means includes a slot in the housing of the device and a tool for insertion into the slot to act as a stop shoulder for the movable one or ones of said housing elements involved.

* * * * *